United States Patent [19]

Cillario

[11] Patent Number: 4,510,735

[45] Date of Patent: Apr. 16, 1985

[54] WRAPPING OF SPHERICAL OBJECTS HAVING SMALL PROTRUSIONS

[75] Inventor: Lorenzo Cillario, Alba, Italy

[73] Assignee: Ferrero S.p.A., Alba, Italy

[21] Appl. No.: 454,065

[22] Filed: Dec. 28, 1982

[30] Foreign Application Priority Data

Dec. 30, 1981 [IT] Italy ..... 68723 A/81

[51] Int. Cl.[3] ..... B65B 11/00

[52] U.S. Cl. ..... 53/464; 53/226

[58] Field of Search ..... 53/464, 226, 480, 221, 53/222

[56] References Cited

U.S. PATENT DOCUMENTS

| | | | |
|---|---|---|---|
| 682,823 | 9/1901 | Tripp | 53/226 |
| 2,624,993 | 1/1953 | Robertson | 53/226 |
| 2,627,709 | 2/1953 | Schlicksupp | 53/226 |
| 2,830,417 | 4/1958 | Ullman et al. | 53/464 |
| 2,915,861 | 12/1959 | Voullaire | 53/464 |
| 3,245,198 | 4/1966 | Schmied | 53/464 |

*Primary Examiner*—W. D. Bray

*Attorney, Agent, or Firm*—Bernard, Rothwell & Brown

[57] ABSTRACT

The object to be wrapped is deposited on thin aluminium foil which extends over the mouth of a forming device comprising an annulus and a plurality of resilient blades each fixed at one end to the annulus and converging at their other, free ends towards a first half mould having a hemispherical cavity coaxial with the annulus. A push rod is advanced axially of the preforming device to push the object and the aluminium foil between the resilient blades, making the foil adhere to the leading surface of the object and effecting a first moulding of the aluminium foil around the trailing surface of the object. The partially wrapped object is expelled from the forming device the blades of which close to effect a second moulding of the aluminium foil over the trailing surface of the object, forming a rear projection in the form of a tail constituted by that part of the aluminium foil which does not adhere to the object. The object expelled from the forming device is transferred into the cavity of the first half-mould, while a second half-mould is having a hemispherical cavity facing the first half-mould is displaced axially of the first half-mould through the forming device so as to squash the rear projection of aluminium foil against the object.

6 Claims, 9 Drawing Figures

Figure 1:
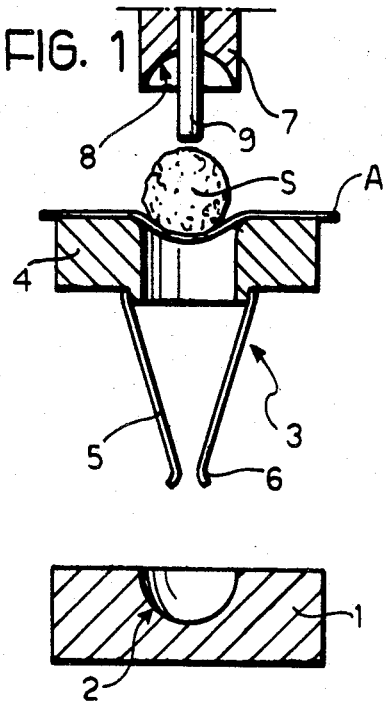

13
14
15a
15b
16a
16b

WRAPPING OF SPHERICAL OBJECTS HAVING SMALL PROTRUSIONS

The present invention relates to processes for wrapping a spherical object in thin aluminium foil, and is concerned particularly with a process for wrapping a spherical object having small protrusions distributed over its surface.

Processes are known in the art for wrapping smooth spherical objects in aluminium foil; these processes are not generally applicable to spherical objects having small protrusions distributed over their surfaces.

In a typical example of use, the spherical object is constituted by a spherical confectionery product covered by chocolate paste containing chopped hazelnuts.

In this case, the use of processes intended for the wrapping of smooth spherical products causes damage to the surface of the confectionery product with considerable detriment to the overall aesthetic appearance of the product itself.

In order to wrap such products it has thus been necessary until now to resort to manual packing processes or rather complex automatic processes which are expensive both in terms of time and cost.

The aim of the present invention is to provide a process for wrapping a spherical object having small protrusions distributed over its surface in thin aluminium foil which does not have the disadvantages specified above and is rapid and easy to carry out.

In order to achieve this aim, the present invention provides a process of the type specified above, characterised in that it includes the steps of:

providing a first half mould having a hemispherical cavity, a second half-mould having a hemispherical cavity facing the first half-mould, means for displacing the second half-mould axially from a raised position so as to bring it into contact with the first half-mould, a forming device interposed between the first half-mould and the second half mould when in its raised position, the device comprising an annulus and a plurality of resilient blades each fixed at one end to the annulus and converging at their other free ends towards the first half-mould, a pusher rod slidable through the second half-mould and the forming device and means for displacing the push rod axially;

placing the aluminium foil on the surface of the annulus of the forming device which is opposite the first half-mould;

depositing the object to be wrapped on the aluminium foil;

advancing the push rod to push the object and the aluminium foil between the free ends of the resilient blades of the forming device to make the aluminium foil adhere to the leading surface of the object and effect a first moulding of the aluminium foil around the trailing surface of the object;

expelling the object which has been partially wrapped by the forming device by means of the push rod so as to cause the blades to open out resiliently due to the passage of the object through the converging free ends of the blades and the subsequent closing of the blades to effect a second moulding of the aluminium foil around the trailing surface of the object and form a rear projection in the form of a tail constituted by that part of the aluminium foil which does not adhere to the object;

transferring the object expelled from the forming device to the cavity of the first half-mould, and displacing the second half-mould axially from the raised position to bring it into contact with the first half-mould so as to squash the rear projection of aluminium foil against the object.

A further subject of the present invention is constituted by a machine for wrapping a spherical object having small protrusions distributed over its surface in thin aluminium foil, characterised in that it comprises:

a supporting framework;

a first half-mould supported by the framework and having a hemispherical cavity, a forming device comprising an annulus coaxial with the cavity of the first half mould and a plurality of resilient blades each fixed at one end to the annulus and converging at their other free ends towards the first half-mould;

a punch slidable axially through the forming device and having a hemispherical cavity constituting a second half mould at its end facing the first half-mould, the punch comprising a central rod and an outer tubular body slidable axially relative to the rod, and actuator means acting on the central rod push and the outer tubular body to move the central rod and the tubular body through the forming device in a predetermined periodic sequence between a withdrawn position, in which the punch and the first half-mould lie on opposite sides of the forming device, and an advanced position in which the second half-mould is in contact with the first half-mould.

By virtue of this characteristic, the machine according to the invention allows a spherical object having small surface protrusions to be wrapped in thin aluminium foil in a rapid and simple manner without requiring any manual intervention.

Figure 4:
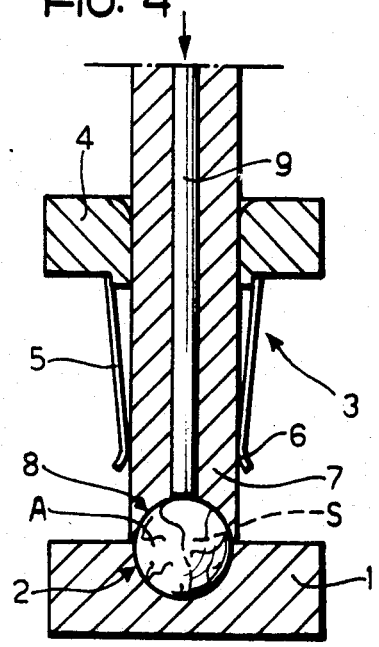
Figure 5:
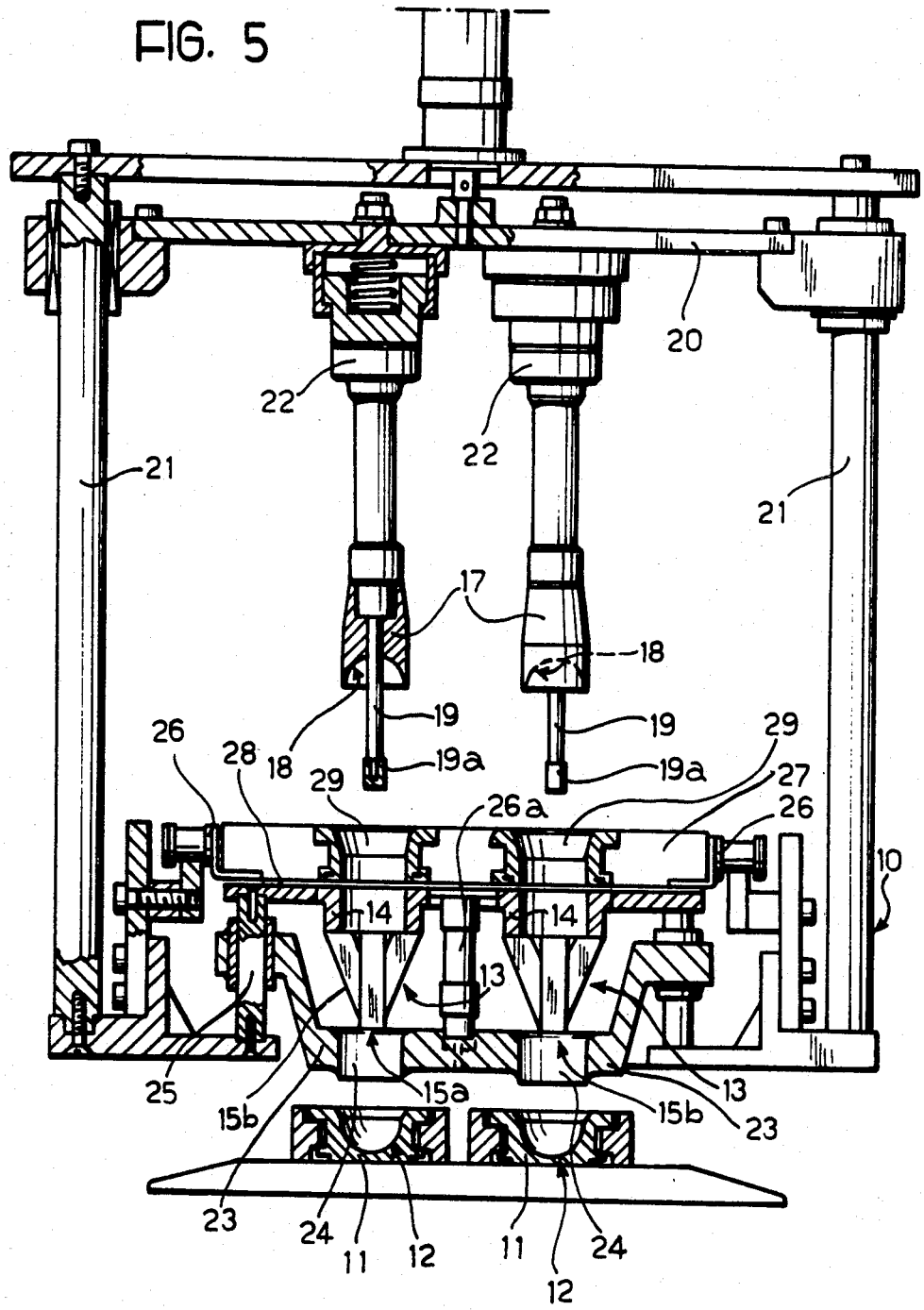
Figures 6, 7, 8, 9:
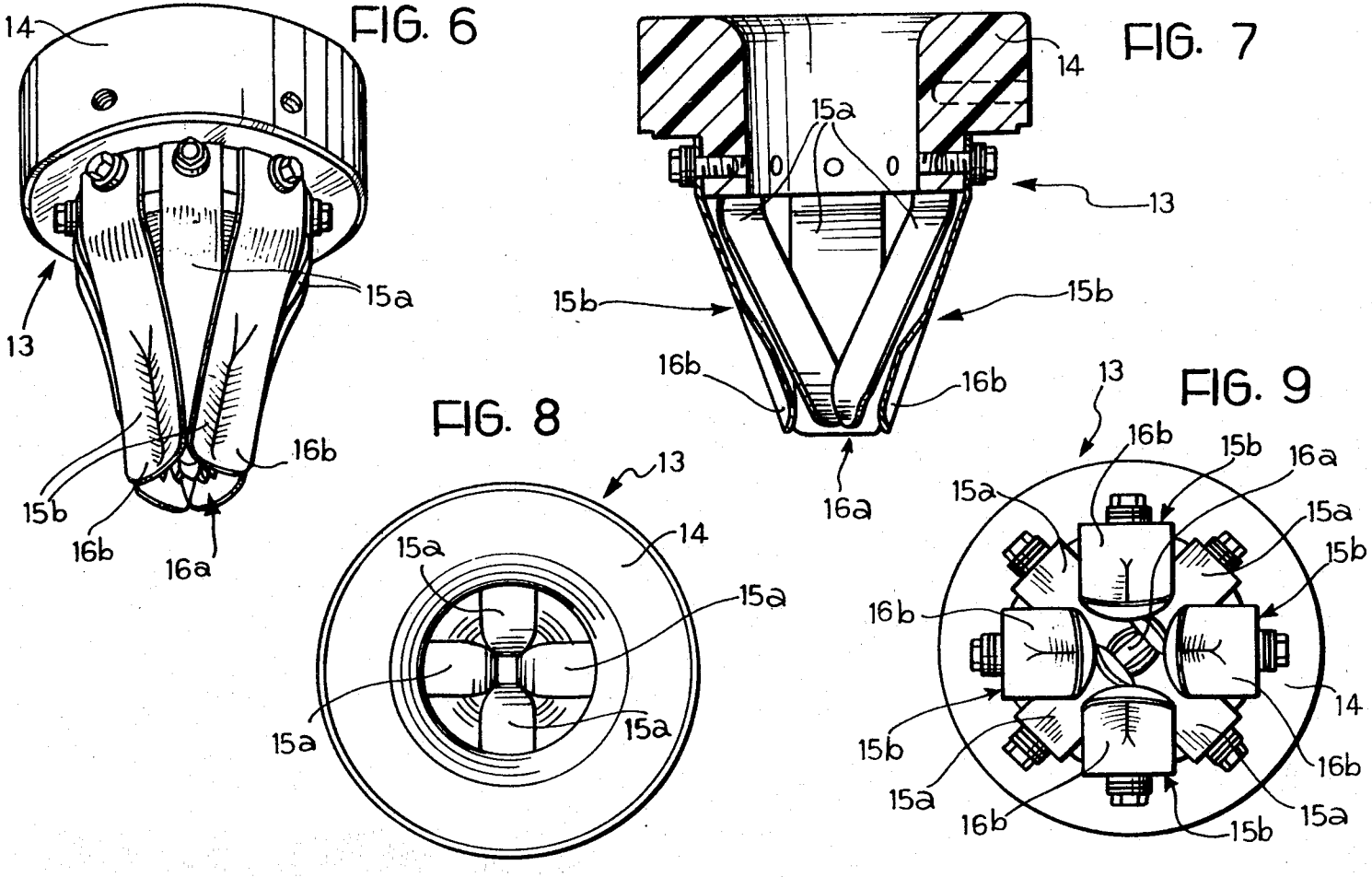

The invention will now be described, purely by way of non-limiting example, with reference to the appended drawings, in which:

FIGS. 1 to 4 illustrate the process according to the invention schematically, FIG. 5 is a partially sectioned elevational view of a machine according to the invention, FIG. 6 is a perspective view of one of the elements illustrated in FIG. 5 on an enlarged scale, FIG. 7 is an axial sectional view of the element illustrated in FIG. 6, FIG. 8 is a first view in an axial direction of the element of FIG. 6, FIG. 9 is a second view in the opposite axial direction from FIG. 8 of the element of FIG. 6.

In FIGS. 1 to 4 a spherical objects having small protrusions distributed over its surface is constituted, for example, by a confectionery product covered with chocolate paste containing chopped hazelnuts.

Thin aluminium foil A is intended to be wrapped around the object S so as to form a wrapping.

A first half-mould 1 has a hemispherical cavity 2.

A forming device 3 comprising an annulus 4 overlies the first half mould 1 and is coaxial with the hemispherical cavity 2; a plurality of resilient blades 5 extend from the annulus 4 with their ends 6 convering towards the first half-mould 1.

A second half mould 7 has a hemispherical cavity 8 coaxial with the hemispherical cavity 2 and facing the first half-mould 1.

The second half-mould 7 is slidable through the forming device 3 between a raised position (FIG. 1 and FIG.

2) in which the forming device 3 is interposed between the first half mould 1 and the second half mould 7, and a lowered position (FIG. 4) in which the second half mould 7 is in contact with the first half mould 1.

A push rod 9 is slidable axially through the second half-mould 7 and is also movable through the forming device 3.

In FIG. 5 a support framework, which carries a pair of first-half moulds 11 each with an upwardly facing hemispherical cavity 12, is generally indicated 10.

Above the first half-mould 11, the framework 10 carries a pair of forming devices 13 each of which includes an annulus 14 coaxial with the underlying cavity 12.

As best seen in FIGS. 6 to 9, first and second resilient blades 15*a*, 15*b* extend from the annulus 14 of each forming device 13 and are arranged in an alternating sequence around the edge of the annulus 14.

The blades 15*a*, 15*b* are shaped so that in the rest position illustrated in FIGS. 6 to 9, the free ends 16*a* of the first blade 15*a* are in contact with each other in an axial position relative to the annulus 14.

In the same rest position, the free ends 16*b* of the second blades 15*b*, extend so as to partially cover the slots between the first blades 15*a*.

As will be seen below, the blades 15*a*, 15*b* are intended to open out to allow the object to be wrapped to pass between them. In order to facilitate the intended return of the blades 15*a*, 15*b* into the rest position described above, the ends 16*b* of each second blade has the form of a dihedron opening downwardly of the forming device 13.

The free ends 16*a* of the first blades 15*a*, however, are tapered.

Preferably, the tips of the free ends 16*a*, 16*b* of the blades 15*a*, 15*b* diverge radially outwardly of the forming device 13.

As illustrated in FIG. 5, a punch located in axial alignment with each forming device 13 is slidable in a vertical direction relative to the framework 10 and comprises a tubular outer body 17 having, at its end facing the respective first half mould 11, a hemispherical cavity 18 which constitutes a second half-mould complementary to the first half-mould 11.

The tubular body 17 is slidable axially on a central push rod 19 which is moved vertically relative to the forming devices 13 by a slide 20 slidable on pillars 21 of the framework 10, which act as guides.

Each tubular body 17 is supported by the slide 20 with the interposition of a linear actuator 22 22 which allows each tubular body 17 to slide axially relative to the respective central rod 19.

Preferably, the end of the push rod 19 facing the first half-mould 11 also has a cavity 19*a*. The cavity 19*a* has a spherical surface and, in the position in which the rod 19 is completely housed in the axial cavity of the tubular body, is intended to occupy the polar portion of the hemispherical cavity 18.

Between the forming devices 13 and the first half moulds 11 is located a transfer device 23 constituted by a plate having holes 24 each of which is coaxial with the forming device 13 above it.

The transfer device 23 is slidable vertically on pillars 25 of the framework 10 under the action of a linear actuator 26*a*.

The framework 10 also has a pair of horizontal guides 26 which traverse the portal defined by the pillars 21 and the slide 20.

A guide plate 27 which is slidable on the horizontal guides 26 forms a space 28 relative to the mouth surface of the forming devices 13 for receiving thin aluminium foil (not illustrated in FIG. 5) divided into portions each of which is intended to wrap an object.

The plate 27 is provided with holes 29 each of which is coaxial with a forming device 13.

In use of the machine, a spherical object to be wrapped is placed in each of the holes 29, for example, at a loading station (not illustrated) located adjacent the machine according to the invention.

With the advance of the guide plate 27 along the guides 26, each of the objects to be wrapped is positioned over the mouth of a respective forming device 13, where it is supported by a corresponding portion of aluminium foil, as illustrated schematically in FIG. 1.

As soon as the object to be wrapped has been brought into axial alignment with the forming device 13, the slide 20 is operated so as to cause downward movement of the rods 19.

Simultaneously each linear actuator 22 is operated so as to keep the corresponding outer tubular body 17 in the withdrawn position relative to the push rod 19 which thus projects downwardly from the hemispherical cavity 18.

Figure 2:
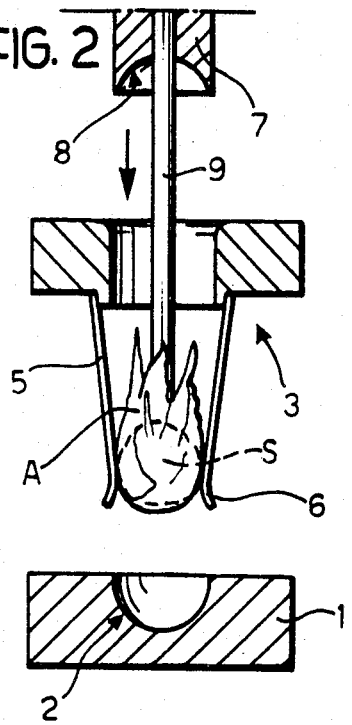
Figure 3:
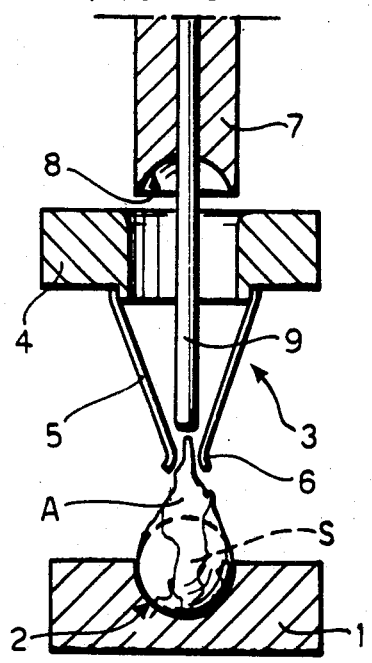

The lowering movement of the rods 19, as schematically illustrated in FIG. 2, causes the advancement of the object to be wrapped and of the aluminium foil between the resilient blades 15*a*, 15*b* the forming device 13.

Thus, the aluminium foil is made to adhere to the leading surface of the object.

During the advance, the resilient blades open out and effect a "combing" action on the object, causing a first moulding of the aluminium foil over the trailing surface of the object.

Its vertical movement being continued, the push rod 19 expels the object which has been partially wrapped from the forming device 13.

The closing of the blades 15*a*, 15*b* during the expulsion of the object effects a second moulding of the aluminium foil over the surface of the object. Thus, a rear projection in the form of a tail is formed which is constituted by that part of the aluminium foil which does not adhere to the object.

The arrangement of the blades 15*a*, 15*b* around the edge of the annulus 14 and the shape of the ends 16*a*, 16*b*, which become aligned about the circumference of greatest section of the object, in the position of maximum divergence (FIG. 2) make the resilient blades close in an orderly manner during the expulsion of the object from the forming device 13. The rear tail-like projection is thus formed without giving rise to tears or substantial assymetry of the tail.

At the end of the expelling action, which in addition to the pushing action exerted by the rod 19, contributes to the return force of the resilient blades 15*a*, 15*b*, the object is received in the cavity 12 of the first half mould 11.

In synchronism with the advancement of the object between the lower end of the forming device 13 and the cavity 12, the transfer device 23, which is normally in the raised position illustrated in FIG. 5, is lowered due to the operation of the linear actuator 26*a* and is brought into contact with the first half moulds 11.

The transfer device 23 guides the object during this advancement, ensuring that the tail constituted by that part of the aluminium foil which has not yet adhered to the object stays in its axial position relative to the cavity 12.

As soon as the object has been expelled from the forming device 13, the linear actuators 22 and the slide 20 may be operated so as to slide each tubular body 17 slide along the respective central rod 19 to align the end cavity 19*b* of each rod 19 with the polar part of the corresponding hemispherical cavity 18 and, passing through the moulding device 13, to bring the hemispherical cavity, which acts as the second half-mould, into contact with the corresponding hemispherical cavity 12 of the first half-mould.

As illustrated schematically in FIG. 4, this action produces the squashing of the rear projection constituted by that part of the aluminium foil not yet adhering to the object against the object. Thus the wrapping operation is completed and, after the punches carried by the slide 20 and the transfer device 23 have been returned upwardly, the wrapped products contained in the first half mould 11 may be taken to further wrapping operations.

The movement of the punches through the forming devices 13 is facilitated by the fact that the tips of the free ends 16*a*, 16*b* of the resilient blades 15*a*,15*b* diverge radially outwardly of the forming device 13.

These tips do not therefore interfere with the movement of the head part of the tubular bodies 17.

Naturally, while the principle of the invention remains the same, the details of realization and forms of embodiment may be varied widely from that described and illustrated, without thereby departing from the scope of the present invention.

I claim:

1. A machine for wrapping a spherical object having small protrusions distributed over its surface in alumium foil, comprising:

a supporting framework;

a first half-mould supported by the framework and having a hemispherical cavity;

a forming device comprising an annulus coaxial with the cavity of the first half-mould and a plurality of resilient blades each fixed at one end to the annulus and converging at their other, free ends towards the first half-mould;

a punch slidable axially through the forming device and having a hemispherical cavity constituting a second half-mould at its end facing the first half-mould, the punch comprising a central rod and an outer tubular body slidable axially relative to the rod, and actuator means acting on the central rod and the outer tubular body to advance the central rod and the tubular body through the forming device in a predetermined periodic sequence between a withdrawn position, in which the punch and the first half-mould lie on opposite sides of the forming device, and an advanced position in which the second half-mould is in contact with the first half-mould.

2. A machine as defined in claim 1, wherein the forming device includes first and second resilient blades arranged in an alternating sequence around the edge of the annulus, the free ends of the first resilient blades being in contact with each other in an axial position relative to the annulus in their rest condition and the second blades extending so as to cover the slots between the first blades.

3. A machine as defined in claim 2, wherein the free end of each said first blade is tapered and the free ends of each said second blade is in the form of a dihedron opening outwardly of the forming device.

4. A machine as defined in claim 2 or claim 3, wherein the tips of the free ends of the resilient blades diverge radially outwardly of the forming device.

5. A machine as defined in claim 1, wherein it further includes a transfer device through which the punch is movable and which is slidable on the framework between the forming device and the first half-mould, and means for bringing the transfer device periodically into contact with the first half-mould in synchronism with said predetermined sequence of movements of the punch.

6. A process for wrapping a spherical object having small protrusions distributed over its surface in thin aluminum foil, comprising the steps of:

(a) placing aluminum foil over a forming device including an annulus and a plurality of resilient blades each fixed at one end to the annulus, the resilient blades having free ends which converge below the annulus;

(b) depositing the object to be wrapped on the aluminum foil;

(c) pushing the object and the aluminum foil through the annulus and between the free ends of the resilient blades to cause adherence of the aluminum foil to the leading surface of the object and to partially wrap the object by affecting a first moulding of the aluminum foil around the trailing surface of the object;

(d) expelling the partially wrapped object through the converging blades, thereby first causing the blades to open out resiliently and thereafter to close due to the passage of the object through the converging free ends, to affect a second moulding of the aluminum foil around the trailing surface of the object and to form a rear, tail-like projection constituted by that part of the aluminum foil not adhering to the object;

(e) transferring the expelled object to a hemispherical cavity of a first half-mould; and (f) squashing the rear projection of aluminum foil against the object by contacting the rear projection with a hemispherical cavity of a second half-mould.

* * * * *

UNITED STATES PATENT AND TRADEMARK OFFICE

CERTIFICATE OF CORRECTION

PATENT NO. : 4,510,735

DATED : APRIL 16, 1985

INVENTOR(S) : LORENZO CILLARIO

It is certified that error appears in the above-identified patent and that said Letters Patent is hereby corrected as shown below:

Column 3, line 31, delete "downwardly" and substitute therefor --outwardly--.

Column 3, line 50, delete the first occurrence of "22".

Column 3, line 57, after "body" insert --17--.

Column 5, line 6, delete "slide".

Signed and Sealed this

*Seventeenth* Day of *September 1985*

[SEAL]

*Attest:*

*Attesting Officer*

DONALD J. QUIGG

*Commissioner of Patents and Trademarks—Designate*